US005445218A

United States Patent [19]

Nieh

[11] Patent Number: 5,445,218

[45] Date of Patent: Aug. 29, 1995

[54] COMPACT HEAT EXCHANGER

[76] Inventor: Sen Nieh, 14345 Hollyhock Way, Burtonsville, Md. 20866

[21] Appl. No.: 198,038

[22] Filed: Feb. 22, 1994

[51] Int. Cl.[6] ..... F28F 13/12

[52] U.S. Cl. ..... 165/125; 165/122

[58] Field of Search ..... 165/125, 122

[56] References Cited

U.S. PATENT DOCUMENTS

| | | | |
|---|---|---|---|
| 1,403,319 | 1/1922 | Harter | 165/125 |
| 4,062,401 | 12/1977 | Rudny et al. | 165/125 |
| 4,909,311 | 3/1990 | Nakamura et al. | 165/41 |
| 5,081,834 | 1/1992 | Darragh | 165/125 X |
| 5,172,752 | 12/1992 | Goetz, Jr. | 165/41 |

FOREIGN PATENT DOCUMENTS

| | | | |
|---|---|---|---|
| 815041 | 7/1937 | France | 165/125 |
| 2303258 | 10/1976 | France | 165/125 |
| 1210185 | 10/1970 | United Kingdom | 165/125 |

*Primary Examiner*—Allen J. Flanigan

*Attorney, Agent, or Firm*—Cushman Darby & Cushman

[57] ABSTRACT

A heat exchanger includes an annular body having a central cylindrical volume having an inlet for one fluid at opposite ends; a plurality of peripherally located first fluid inlets communicate with first fluid passages in the body which passages curve arcuately outwardly to respective separate outlets on the exterior wall of the body; another set of passages for another fluid extend axially from one end of the body to the opposite end between oppositely located plenum chambers; the another set of passages are interposed between the first fluid passages.

13 Claims, 4 Drawing Sheets

COMPACT HEAT EXCHANGER

FIELD OF THE INVENTION

This invention relates to compact heat exchange structures and, more specifically, to heat exchange structures that will provide more efficient thermal transfer between fluids of different temperature. In one embodiment, the heat exchanger of this invention will be readily able to be connected in series to accommodate a greater range of temperature differentials while reducing the space that heretofore has been required to effect such heat transfer between fluids.

BACKGROUND OF THE INVENTION

In many industrial and commercial environments and particularly in the operation of motor vehicles and stationary machinery, the necessity of providing thermal control of fluids requires the use of fluid heat exchangers that reliably operate over wide temperature ranges and heat capacities. Typically, the prior art has developed complex paths for at least two fluids to prolong the heat exchange relation between the fluids and this has correspondingly complicated the manufacturing steps required to produce the structures and invariably increased the cost of manufacturing such heat exchange devices. In many cases, design simplification to reduce manufacturing steps and costs often results in limiting the temperature range of the fluids that the devices are capable of handling. In other cases, manufacturers have resorted to the use of expensive materials that are frequently difficult to work with to improve the performance of the heat exchange structures. Other solutions have involved simply increasing the surface areas of the heat exchanger which the fluids contact although isolated from each other, This obviously constrains the locations where the exchanger is able to be installed particularly where the thermal control is needed in connection with the operation of stationary machinery or of a power source such as an internal combustion engine that has been previously constructed. In still other attempts, manufacturers have resorted to the use of pumps to improve throughput but these increase the the power consumption of the apparatus and this solution will correspondingly increase the cost of apparatus both in terms of construction and operation.

SUMMARY OF THE INVENTION

This invention provides improved heat exchange structures that will be relatively less expensive to manufacture both in terms of material costs and manufacturing steps and one where the compact size of the unit does not materially compromise the temperature range of the fluids that the unit will handle.

In a preferred embodiment, the unit includes a central chamber for receiving the first fluid which may be at a lower temperature than the second fluid. Where that fluid is a gas, a blower or a fan may be employed to regulate flow into the unit. The central chamber is provided with an array of apertures distributed over at least a portion of its surface and which are spaced along the wall of the chamber generally parallel to the axis of the chamber which is cylindrical in shape. The central chamber is surrounded by a second annular chamber having at one end a plenum chamber having an inlet for the second fluid. The second chamber has distributed around its axis an array of flow paths which smoothly curve from the wall of the first chamber to the outer wall of the second chamber. At least one of the curved flow paths in the second chamber is open at one end to the plenum chamber to receive fluid therefrom. In one form, at the opposite axial end, the one of the curved flow paths is in communication with the adjacent curved flow path. The subsequent curved flow paths are similarly connected to receive flow from a preceding curved flow path so that the flow of fluid in the second chamber will be substantially in an axial direction along the curved flow paths with the flow in adjacent paths being in opposite directions. The flow paths of the second chamber are spaced apart from one another to define flow paths for the first fluid each of which is in communication with an aperture in the wall of the first chamber with the opposite ends being open to either the atmosphere or to a plenum chamber provided on the external wall of the second chamber.

In one embodiment, the flow paths for the first fluid that traverse the second chamber are unobstructed. In another embodiment, metal fins are provided extending between the walls of adjacent flow paths of the one or both of the fluids. In a still further embodiment, the flow paths of the second fluid are further divided in the form of discrete thin tubes the external surfaces of which define the flow paths of the first fluid.

With these compact structures, a highly efficient heat exchange operation will be achieved primarily due to the dwell time of fluids during which the fluids are in heat exchanging relation along the paths of the fluids. The provision of fins in one of the paths, the number and surface areas of which may be readily selected, will provide the ability to handle large temperature differences and large heat capacities between the two fluids.

The foregoing and other advantages of this invention will become apparent as consideration is given to the following detailed description taken in conjunction with the accompanying drawings, in which:

DETAILED DESCRIPTION OF THE INVENTION

Figure 1:
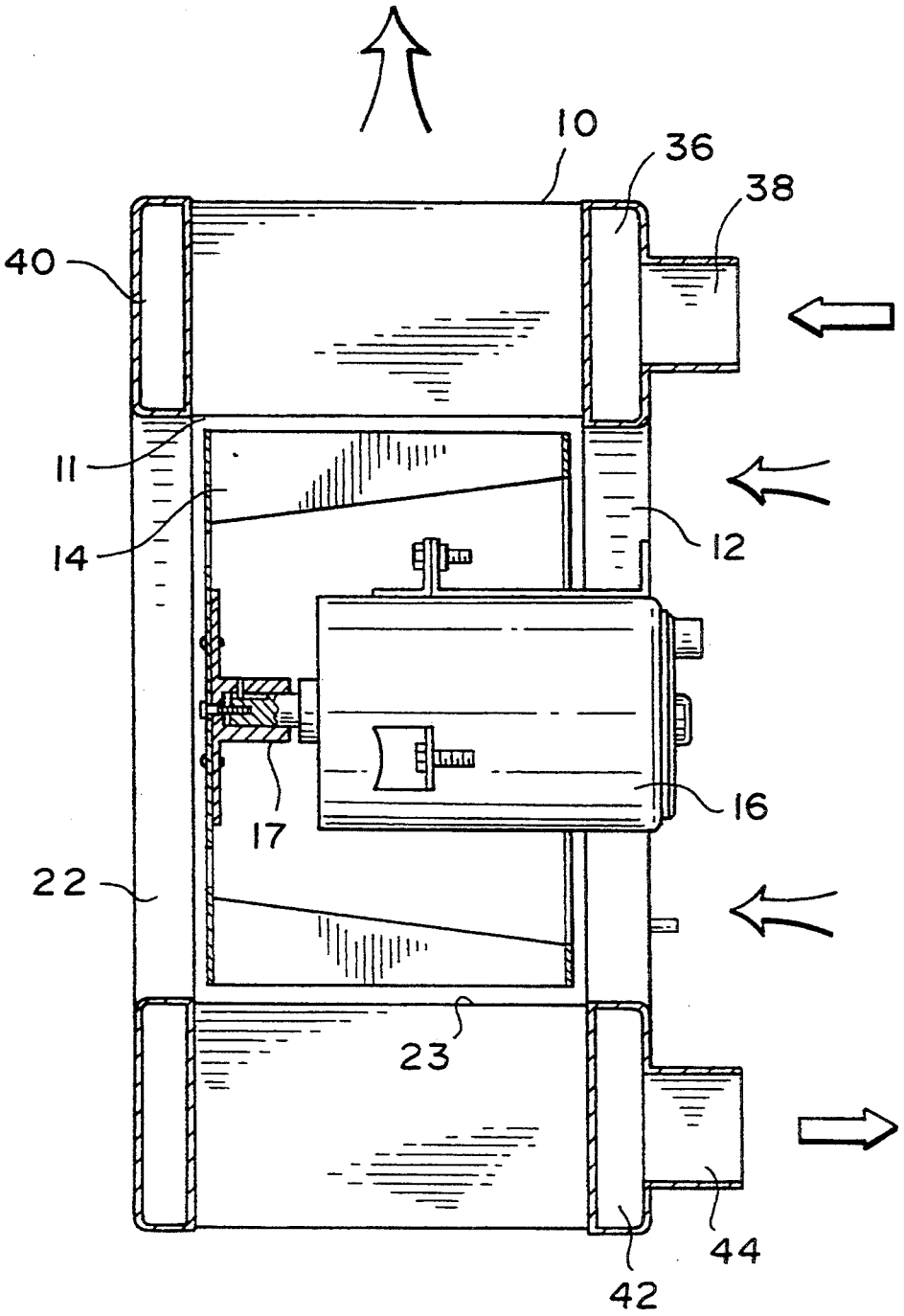
FIG. 1 is side view in elevation of the heat exchanger of the present invention.
Figure 2:
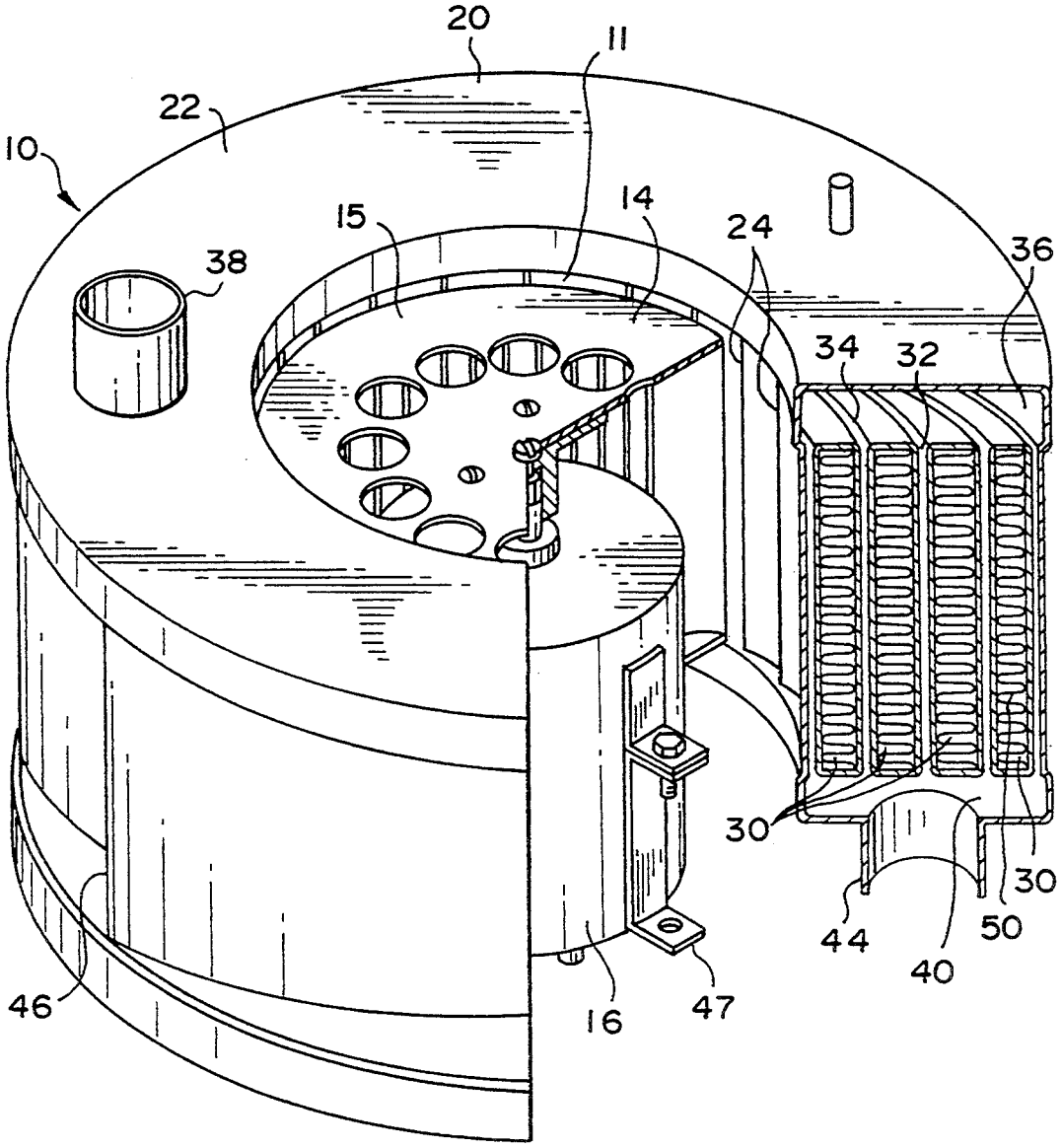
FIG. 2 is a perspective view with parts broken away to show the interior of the embodiment of FIG. 1.

Referring now to the drawings wherein like numerals designate corresponding parts throughout the several views, there is shown in FIGS. 1 and 2, one embodiment of the present invention which comprises a casing heat exchanger 10 which, in the illustrated embodiment, has a central, cylindrical chamber 11 with an annular inlet 12 at one end for a first fluid such at air. In this embodiment, the air will serve as the lower temperature fluid and the higher temperature fluid will be heated water such as from a motor vehicle engine cooling system. In the central chamber 11, there is located a blower or fan 14 which preferably is a so-called squirrel cage type having an axially mounted electric moter 16. As will be obvious to those skilled in this art, other types of fluid movers may be employed other than the illustrated blower 14. The blower 14 is mounted on a shaft 17 connected to the output shaft of the drive motor 16. The end of the chamber 11 may be open .

In this embodiment, the cylindrical chamber 11 is provided with an internal cylindrical surface zone or wall provided with a plurality of slots or apertures such as at 24 (FIG. 2) which are distributed substantially evenly about the! the longitudinal axis of the chamber 11, i.e. parallel to the axis of shaft 17 and the length of the wall of the chamber 11 and about a portion or all of the circumference of the wall of the chamber 11 so that the apertures 24 will be each aligned with a flow passage 30. The outer annular body 20 is provided with the flow passages 30 which are formed by thin metal walls 32 which between them define the smoothly curved passages of both the passages 30 and alternately the flow passages 34 for the second fluid which, in this case, will be hot water or other conventional engine coolant. A selected number of the passages 34 receive the incoming hot fluid from a plenum chamber 36 which is provided with an inlet 38. The hot fluid passes along the length of the body 20 through the selected number of passages 34 and then passes to a second plenum chamber 40 at the opposite end of the body 20. The second chamber 40 passes the hot fluid in this embodiment to the outlet 44 which preferably is located on a diametrically opposite side of the body 20. The first fluid, such as air, removes heat from the second fluid as it passes in heat exchange relationship therewith along the flow passages 30 to be expelled through exit apertures 46 on the periphery of the body 20 as shown in FIG. 2.

Figure 3:
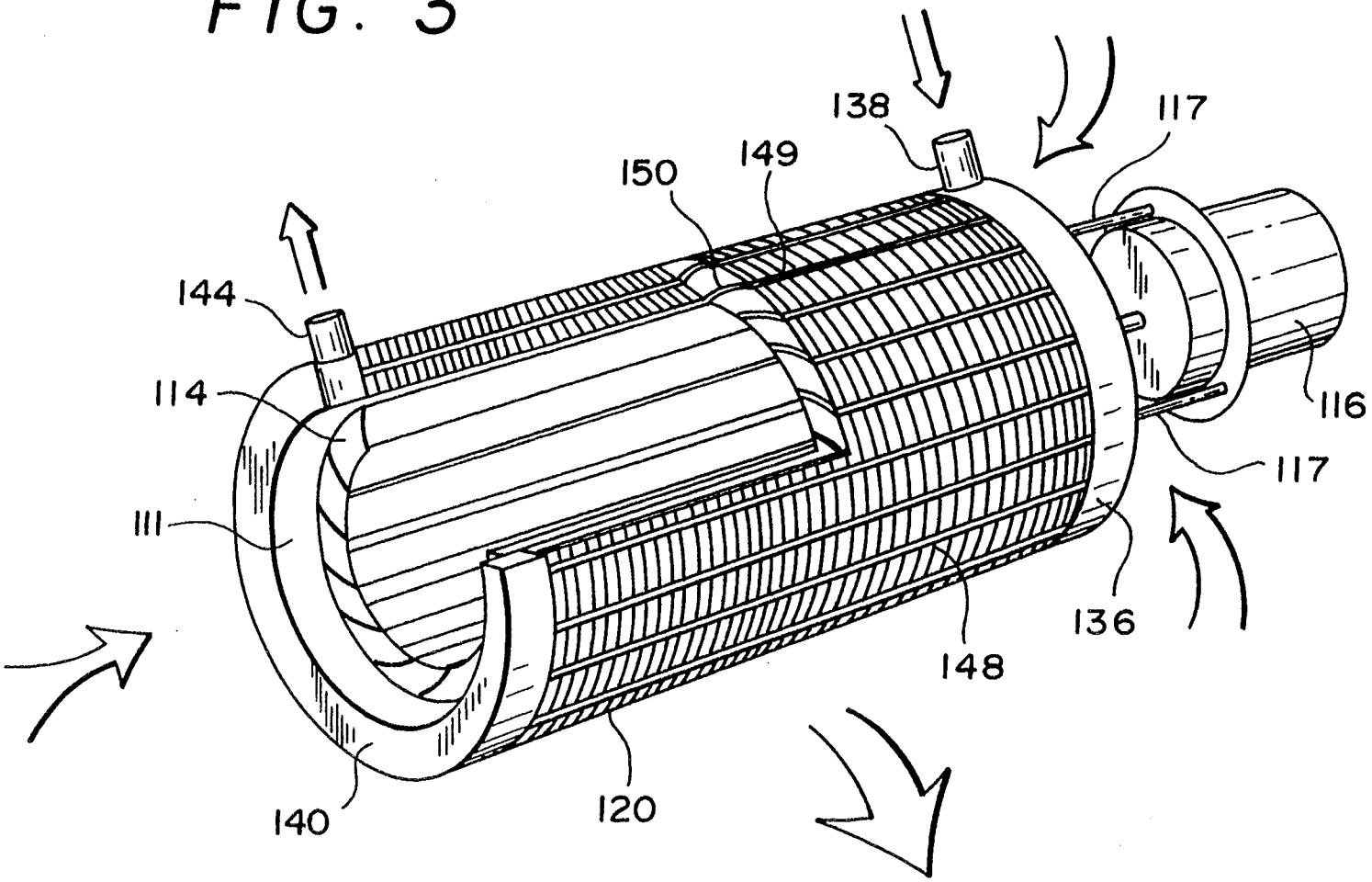
FIG. 3 is perspective view similar to FIG. 2 of another embodiement.

The motor 16 will be mounted on arms such as shown in connection with the FIG. 3 variant connected each to a fixture, one of which is shown at 47 with the arms mounted on an adjacent portion of the wall of chamber 36 or other available support.

The shown squirrel cage blower 14 is preferred and will effectively draw cooler air in through the open ends 22 of the body 10 and through the large apertures formed in the end plates, one of which is shown at 15 in FIG. 2.

Figure 4:
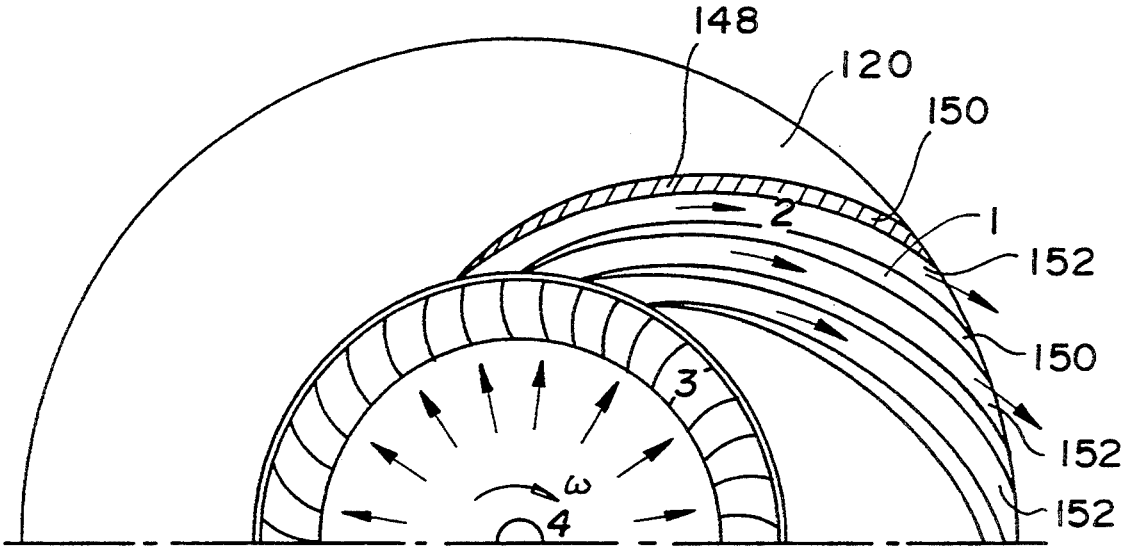
FIG. 4 is a schematic view of the flow paths of the embodiment of FIG. 3.

In the variant of FIG. 3, several common elements corresponding to those of the above described variant will be numbered with the same concluding digits but raised by 100. The central chamber 111 is elongated and contains the squirrel cage blower 114 rotatably mounted therein in a manner similar to that of the above described form. The motor 116 is mounted externally on axially extending arms 117 which extend from the face of an inlet plenum chamber or header 136, the face having an opening similar to opening 12 of the previous embodiment. The outer body 120 includes axially directed flow passages 150 which receive the first fluid from the end located chamber 136 through inlet 138. Also, as seen more clearly in FIG. 4, the flow passages 150 are formed as arcuate cells 148 which extend along the axial length of the body 120 between the plenum chambers 136, 140. The radial flow passages 152 for the second fluid are configured generally like the flow passages 30 extending between apertures 24 and 46 of the variant of FIGS. 1 and 2. In the variant of FIGS. 3 and 4, these passages 152 are preferably provided with radially extending walls 149 welded along there abutting edges or sides to the metal walls of the passages 150 to prevent leakage of the first fluid between the respective passages. Also, the passages 150 may be oblate in shape to present a broader surface area to the passages 150. With this arrangement, fewer flow passages 150 will be required as compared to the embodiment of FIGS. 2. However, a slightly higher power consumption is expected to be required for operation.

In each embodiment, the flow passages 30 and 152 for the air leaving the central chamber 11 or 111 may be provided with transverse metal fins 50 as shown in FIG. 2. Preferably, for manufacturing convenience, the fins 50 may be arranged as an undulating sheet in each passage extending the length of each passage 30 with the sheets secured at their crests to the wall 32 or surface of the passages 148 by welding or the like. This will ensure efficient heat transfer.

While the design shown in FIG. 2 is readily capable of installation in compact sites, it is not essential that the blower motor be located in the central chamber 11, as will be apparent to the skilled craftsman. Also, the inlets and outlets for the second fluid may be located in spaced relationship at the same end of the plenum chambers with appropriate dividing walls inserted to separate the incoming and exiting second fluid.

To facilitate heat transfer, it is preferred that the individual fins 50 be made of metal and that their peripheral edges be welded or soldered to the peripheral side wall of the individual passages 30 as noted above.

Having described the invention, it will be apparent to those skilled in this art that various modifications may be made thereto without departing from the spirit and scope of this invention as defined in the appended claims.

What is claimed is:

1. A heat exchanger for a first and a second fluid and comprising an annular body having a longitudinal axis, an exterior and an interior peripheral wall with said interior peripheral wall defining an interior volume, a plurality of first fluid inlets located on said interior peripheral wall in said interior volume and a corresponding plurality of first fluid outlets located on said exterior of said body, said body having a first end and a second end spaced therefrom along said axis, a second fluid inlet adjacent said first end and a second fluid outlet spaced from said second fluid inlet;

said body having interiorly thereof a plurality of first fluid passages extending from each said first fluid inlet on said interior wall to a respective one of said first fluid outlets on said exterior peripheral wall with said first fluid passages each curving smoothly and arcuately from said interior to said exterior peripheral wall;

said body having interiorly thereof a plurality of second fluid passages extending from said first end of said body to said second end thereof and then to said second fluid outlet, said second fluid passages being substantially uniformly interposed between said first fluid passages;

said interior volume of said annular body including a fluid pumping means for pumping a fluid of a selected temperature from said interior volume through said first fluid passages to said first fluid outlets.

2. The invention as claimed in claim 1 wherein said second fluid outlet is located at said first end of said body, said second end of said body having a plenum chamber into which said second fluid passes from at least some of said second fluid passages.

3. The invention as claimed in claim 1 wherein said fluid pumping means is a fan.

4. The invention as claimed in claim 3 wherein said fan is located adjacent said second end of said body.

5. The invention as claimed in claim 1 wherein a motor for said pumping means is mounted in said interior volume.

6. The invention as claimed in claim 1 wherein a motor for said pumping means is mounted externally of said body.

7. The invention as claimed in claim 1 wherein at least some of said first fluid passages include heat transfer means.

8. The invention as claimed in claim 7 wherein said heat transfer means comprises metal fins.

9. The invention as claimed in claim 8 wherein said metal fins in each said some of said first fluid passages is formed by an undulating metal sheet extending from adjacent one end of said first end to adjacent said second end of said body.

10. The invention as claimed in claim 9 wherein said first fluid passages are defined by metal walls and each said sheet includes a plurality of crests, said crests being secured to a respective metal wall.

11. The invention as claimed in claim 1 wherein said body is provided with a plenum chamber at said first and second ends thereof, said first fluid inlet communicating with one of said plenum chambers and said first fluid outlet communicating with the other of said plenum chambers.

12. The invention as claimed in claim 11 wherein said first fluid passages are separated along said longitudinal axis by radially extending sheets, said sheets having axially extending openings receiving barrier means defining said second fluid passages, said barrier means extending from one plenum chamber to the other plenum chamber.

13. The invention as claimed in claim 1 wherein said fluid pumping means is a squirrel cage blower.

* * * * *